US005574235A

United States Patent [19]

Scotese

[11] Patent Number: 5,574,235

[45] Date of Patent: Nov. 12, 1996

[54] HARMONICA HOLE SHIELD

[76] Inventor: Joseph A. Scotese, 21 New St. Apt. 2F, Binghamton, N.Y. 13903

[21] Appl. No.: 491,811

[22] Filed: Jun. 19, 1995

Related U.S. Application Data

[63] Continuation-in-part of Ser. No. 231,746, Apr. 25, 1994, abandoned.

[51] Int. Cl.[6] ..... G10D 7/12

[52] U.S. Cl. ..... 84/377; 84/453; 84/470 R

[58] Field of Search ..... 84/377, 378, 379, 84/453, 470 R

[56] References Cited

U.S. PATENT DOCUMENTS

| | | | |
|---|---|---|---|
| 922,121 | 5/1909 | Fraser | 84/377 |
| 3,589,232 | 6/1971 | Peters | 84/377 |

*Primary Examiner*—Cassandra C. Spyrou

[57] ABSTRACT

This invention features a U-shaped hole shield, for isolating one harmonica hole at a time, and is sufficiently long to span the lips of a harmonica player. In the center of the face of the U-shaped shield, there is a rectangular aperture with dimensions substantially identical to the dimensions of the rectangular holes of a harmonica. When the shield is placed in position on the harmonica, the rectangular aperture of the shield can be aligned with any desired rectangular hole of the harmonica. Thus, one, and only one, hole of the harmonica will be exposed, while the adjacent holes will be covered, and shielded, by the shield. The musician's lips can be placed against the shield, centered about the aperture, and without the need for the use of the tongue, a single note can be sounded with ease, simply by blowing into, or drawing air out of, the exposed hole. The movement of the shield is controlled by the lips, and the hands move, or slide, the harmonica, sideways, in either direction, relative to the shield. Thus, a complete song can be played, one note at a time; the tongue need not be used.

8 Claims, 3 Drawing Sheets

HARMONICA HOLE SHIELD

This is a continuation-in-part of application Ser. No. 08/231,746, filed on Apr. 25, 1994, now abandoned.

FIELD OF THE INVENTION

This invention pertains to a hole shielding device that facilitates the playing of a harmonica and, in particular, to a shielding device that enables the playing of one single, pure, harmonica note at a time, without need for using the Tongue Blocking Method.

BACKGROUND OF THE INVENTION

The harmonica does not have the human appeal that other musical instruments have. Other musical instruments appear in orchestras, but the harmonica very seldom appears in an orchestra. Most often, the harmonica appears as a solo instrument. The reason may be that it is a difficult task to master the art of playing the harmonica (i.e., of playing one harmonica note at a time). The human mouth spans more than one harmonica hole, making it difficult to sound or play one harmonica note in isolation. Therefore, fewer people resort to playing, and enjoying, the harmonica. If more people are motivated or encouraged to play the harmonica, it may well take its place in orchestras alongside of other wind instruments.

Most wind instruments have a mouthpiece. Fingers are used to aid in sounding single notes. In contrast, the harmonica does not have a mouthpiece. Moreover, the tongue is used to aid in sounding single notes. The recommended manner of playing the harmonica, used by professional harmonica players, is the tongue blocking method.

It is a much easier task to manipulate the fingers than to manipulate the tongue. The fingers are naturally adapted to playing a musical instrument whereas the tongue is not naturally adapted to playing a harmonica.

The tongue blocking method is described as follows. The tongue is brought forward through the parted lips, which span several harmonica holes, and is pressed against, thus blocking, all but one of the holes spanned by the lips. Sufficient space is left between one side of the tongue and the adjacent corner of the lips to blow air into, or draw air out of, the exposed, or unblocked hole. The tongue remains in this position as the harmonica is moved sideways, in either direction, to align each desired hole, for sounding or playing, with the space between the tongue and the corner of the lips. This is a difficult art to master, requiring a great deal of perseverance.

To attempt to sound one note at a time without the use of the tongue would require bringing the lips together in the manner of whistling, allowing a small opening between the lips, sufficient to blow air into, or draw air out of, a single hole. This method is also difficult, perhaps more difficult than the tongue blocking method.

The Peters' invention, U.S. Pat. No. 3,589,232, describes a harmonica hole selector comprising a holder for the harmonica that is slidable thereon and which defines an opening arranged to be aligned with any one of selected openings at the front of the harmonica. An air conduit communicates with the holder opening and extends therefrom a distance at least sufficient to enable a user during use thereof to view the front of the harmonica. The Peters' invention comprises a holder, having top, bottom, front, and rear, surfaces to hold the harmonica in operational position, a window for displaying the numbers, 1 through 10, associated with each harmonica hole, a fingerhold to enable the user to control the holder, a conduit, approximately 4 inches long, which provides an air duct intended to be aligned with any desired harmonica hole, for the purpose of blowing, or drawing, air for sounding a note.

The Peters' invention is a device that enables a user to play one note at a time, without need for using the tongue blocking method, in playing a harmonica. However, Peters' invention is not feasible for use in an orchestra, for the following reasons:

1. The harmonica cannot be played in the customary fashion, with the two hands cupped about the harmonica. The Peters' reference requires one hand on the fingerhold 36, and the other hand on the harmonica. Without the hands cupped about the harmonica, the vibrato effect cannot be employed, which is an essential part of playing a harmonica.
2. All good musicians depend on sound, touch, and memory to perform in an orchestra, while their eyes remain on the music sheet. The Peters' invention is a sight operated device, which requires the eyes to view the number 42 inscribed on the harmonica. It would not be feasible for a musician to depend on aligning the inscribed number 42 on the harmonica with the window 40 in the holder 24 for providing a good performance. The musician's eyes would be required to move quickly from music sheet to the window 40, and back to the music sheet. Also, it would not be feasible to slide the harmonica within the holder 24 from number 42 to number 42, without overslide, or underslide, that is, it would not be feasible to move from one number 42 to another accurately, without hesitation.
3. The probability exists that the harmonica in the Peters' holder 24 will twist out of alignment with the walls 38 and 32 of the holder 24, thus causing the harmonica to wedge itself within the walls and resulting in a momentary pause in the playing of the harmonica. This would create a stop and go effect, which would not be tolerated in an orchestra.
4. The Peters' invention requires the head, and face, to remain motionless, that is, the head, and face, must not turn to either side, nor bob up and down, because the holder 24 must remain stationary, otherwise the harmonica will twist out of alignment, and cause the harmonica to become wedged within the holder 24. This stationary position of the head would cause neck and shoulder muscle strain. A user would be under mild, to severe, strain during prolonged use of the Peters' invention.

The shield presented in this application does not have the above limitations: it is designed to enable a user to handle a harmonica in the customary fashion.

A structural difference between Peters and the shield of this invention requires that the Peters holder 24 be attached to a harmonica, remaining self-attached, provided the harmonica is maintained in a horizontal position. If the harmonica should be placed in a vertical position, then the holder 24 could slide off of the harmonica. The shield of this invention is not attached to the harmonica, and does not, can not, maintain itself proximate the harmonica. The present shield requires contact with the lips to maintain operational position, and proximity to the harmonica. When the lips are removed from the shield, the shield can easily drop off of, fall away from, the harmonica, especially, if the harmonica, while in a horizontal position, is rotated such that the front surface of the harmonica is faced in the downward position.

It would be advantageous to provide a suitable aid whereby beginning students can sound, and play, single, pure, notes and thus learn to recognize, and identify or distinguish, the notes of the scale, in the customary fashion of using a harmonica, without need to use the Tongue Blocking Method.

It would also be advantageous to provide a suitable aid that would facilitate the sounding of single notes without need for using the tongue.

It would also be advantageous to provide a suitable aid to enable students, who do not have tongue dexterity, or perseverance, to learn to play a harmonica well.

It would also be advantageous to provide a mechanism for eliminating the requirement for tongue dexterity for beginning harmonica students.

It would also be advantageous to provide a means of decreasing or eliminating frustration on the part of the beginning harmonica student.

It would also be advantageous to provide a mechanism for preventing unwanted air leakage, from the corners of the lips.

It would also be advantageous to provide a device which would be simple, adaptable, and inexpensive.

Further objects and advantages of this invention will become apparent from a consideration of the drawings and ensuing description.

SUMMARY OF THE INVENTION

This invention pertains to a U-shaped template, or hole shield, of any suitable length sufficient to span the musician's lips. The shield comprises a face, 2 sides, 2 surfaces (front and rear), and 4 edges. Its length spans a minimum of three harmonica holes.

In the center of the face of the shield is a rectangular aperture with dimensions substantially identical to the dimensions of the rectangular holes of a harmonica. When the shield is placed in operative position on the harmonica, the rear surface of the shield is in proximity with the surface of the harmonica, and the rear surface of the face is in proximity with the front surface of the harmonica. Thus, the rectangular aperture therein can be aligned with any desired rectangular hole of the harmonica, and, one, and only one, hole of the harmonica will be exposed, while the adjacent holes will be covered, by the shield. The musician's lips can be placed against the front surface of the face of the shield, centered about the aperture. Thus, without the need for the use of the tongue, a single tone or note can be sounded with ease, simply by blowing into, or drawing air out of, the exposed hole. Then, while the shield is held stationary, relative to the lips, by its contact with the lips, the harmonica can be moved or slid, with the hands, sideways, relative to the shield, in either direction, to bring any other desired rectangular harmonica hole into alignment with the aperture in the shield. Thus, a complete song can be played sounding one note at a time without the need for using the tongue. Notice, in using the shield, the harmonica is played in the customary fashion, with the hands cupped in the customary fashion, such that the listeners would not be aware that a shielding device was being used.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

This invention consists of a U-shaped template, or hole shield, with a rectangular aperture in the center of the face of the shield. This solitary rectangular aperture makes it feasible to sound one single harmonica note at a time when this rectangular aperture is aligned with any desired rectangular hole of the harmonica.

Like elements will have the same designation throughout the figures.

Figure 1:
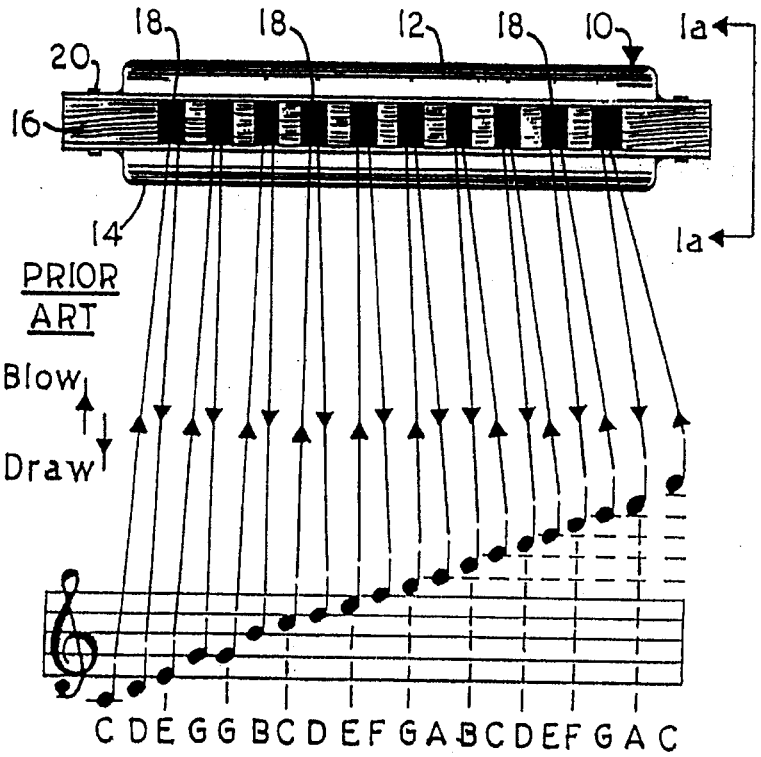
FIG. 1 is an elevation view of a 10-hole harmonica, showing the spacing between holes in the front surface of the harmonica; and an illustration of the complete scale for a 10-hole harmonica.
Figure 1A:
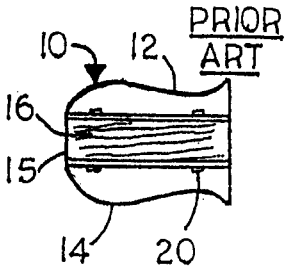
FIG. 1*a* illustrates a section view of the 10-hole harmonica shown in FIG. 1, along lines 1*a*—1*a* thereof.

Referring to FIGS. 1 and 1*a,* a conventional 10-hole harmonica 10 is shown. Sandwiched between the top 12 and bottom 14 is a layer of wood or plastic 16, having rectangular equidistantly-spaced holes 18 formed therein. The front surface 15 (FIG. 1*a*) is the front of the layer 16. The assembly 12, 14, 16 is secured by means of rivets 20. Reeds, not shown, are disposed within the layer of wood or plastic 16 of the harmonica 10.

Each harmonica hole has two reeds; blowing into the hole sounds one of the reeds, while drawing air out of the hole sounds the other reed. Included in FIG. 1, the complete scale of the 10-hole harmonica is illustrated, showing the range of the harmonica, beginning with the left, or lowest note, which is middle C on the piano. It shows that each hole has two reeds for sounding two separate notes, by blowing in, or drawing air out of, the hole.

Figure 2:
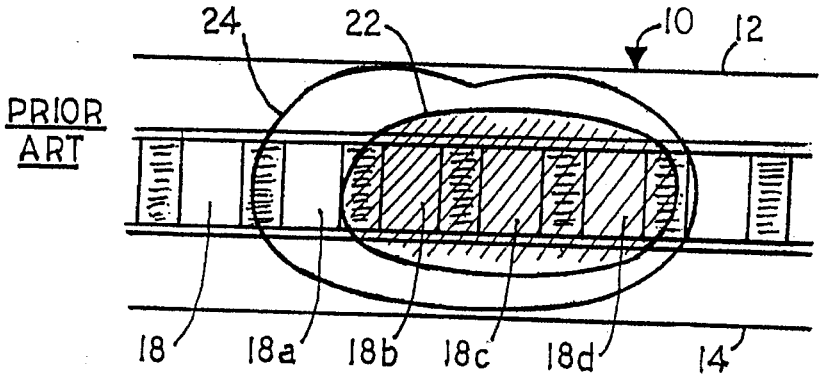
FIG. 2 illustrates a schematic of the tongue blocking method, including outlines of tongue and lips.

Referring to FIG. 2, the tongue blocking method is illustrated. The outline of the tongue is shown as reference numeral 22, and the outline of the lips is shown as reference number 24. As can be seen, the lips span four holes 18*a*, 18*b*, 18*c*, 18*d*, and the tongue blocks three of these holes 18*b*, 18*c*, 18*d*, leaving the fourth hole 18*a* exposed. Sufficient space must be provided between the edge of the tongue (outline 22) and the adjacent corner of the lips (outline 24) for a note to be sounded from the exposed hole 18*a*.

Referring to FIGS. 3–3*b*, and 5–5*b*, the shield 26 of the present invention forms a harmonica overlay, having two sides 28 and 30 and a face 32. Disposed within face 32 is a rectangular aperture 34, having rear edges on the rear surface 32*r* of the face 32 and beveled edges on the front surfaces 32*f* of the face 32, at approximately its center. It should be understood that aperture 34 may also have a square, circular, oval, polygonal or even slotted shape, without departing from the scope of the invention, depending upon the method of manufacture, which can be formed by machining, casting, molding, or any other suitable method well known in the art. The rear edges 35*b*, on the rear surface 32*r* of aperture 34, can be beveled along the rear surface (FIGS. 3*a*, 4*a*, and 5), that is, the rear edges 35*b* could be chamfered to minimize any air leakage between the aperture 34 and the exposed harmonica hole 18 during use. The front edges 36*b*, on the front surface 32*f* of aperture 34, are beveled along the front surface, to minimize any air leakage between the aperture 34 and the user's lips.

Figure 4:
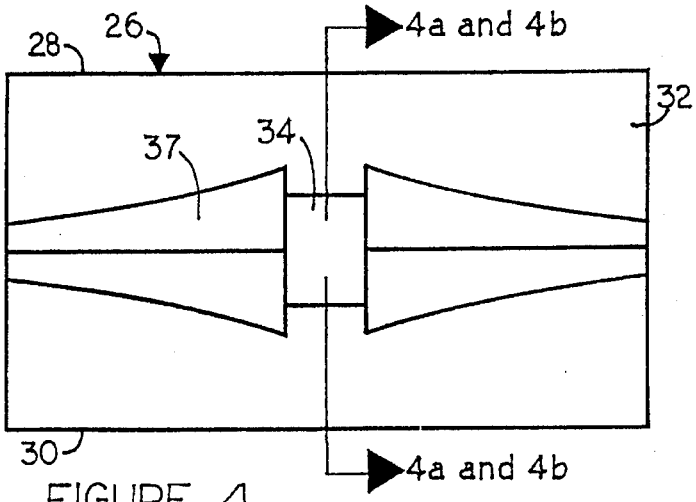
FIG. 4 illustrates a schematic view of the shield in accordance with an alternate embodiment of this invention.
Figure 4A:
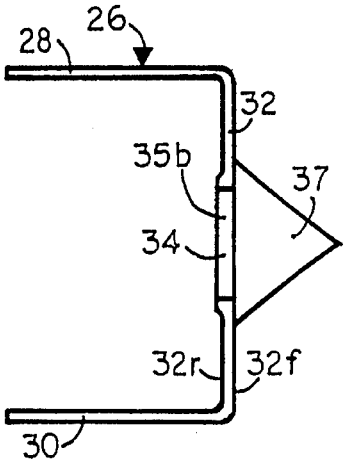
FIG. 4*a* illustrates a cross section view of an alternative embodiment of the shield shown in FIG. 4, along lines 4*a* and 4*b*—4*a* and 4*b* thereof.
Figure 4B:
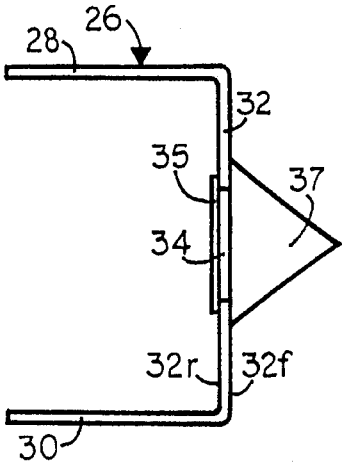
FIG. 4*b* illustrates a cross section view of an alternative embodiment the shield shown in FIG. 4, along lines 4*a* and 4*b*—4*a* and 4*b* thereof.
Figure 5:
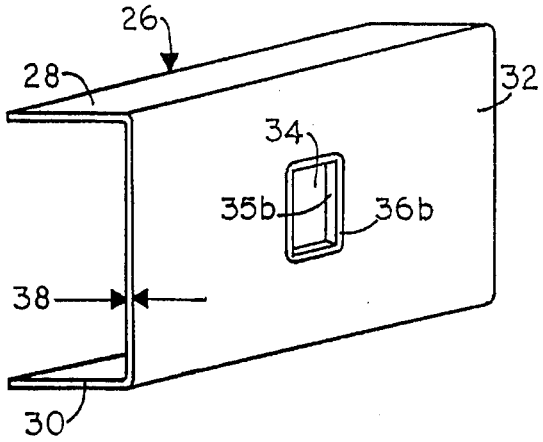
FIG. 5 illustrates a perspective view of the shield shown in FIG. 3*a;*
Figure 5A:
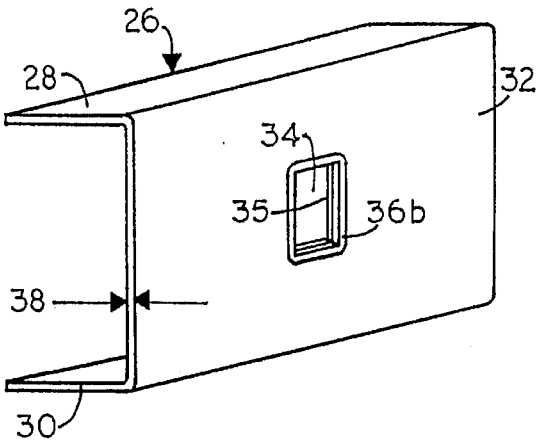
FIG. 5*a* illustrates a perspective view of the shield shown in FIG. 3*b;*
Figure 5B:
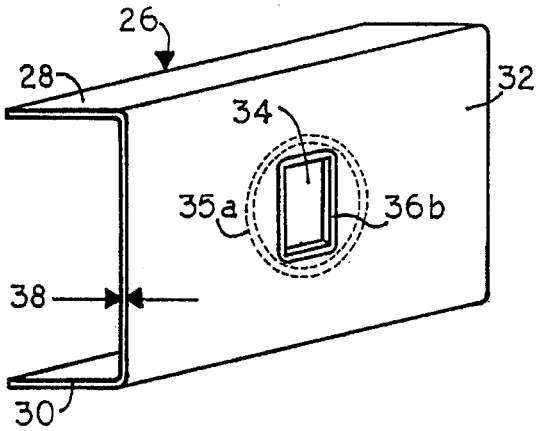
FIG. 5*b* illustrates a perspective view of the shield shown in FIG. 3, wherein an O-ring is shown in phantom on the rear surface.
Figure 5C:
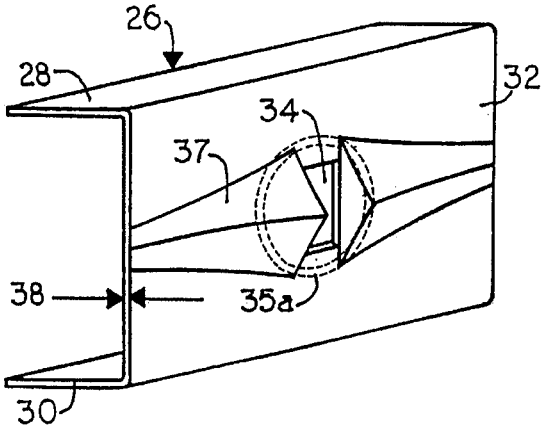
FIG. 5*c* illustrates a perspective view of the alternate embodiment shown in FIG. 4, wherein an O-ring is shown in phantom on the rear surface.

Referring to FIGS. 4–4*b* and 5*c*, the shield 26 is shown having two sides 28 and 30 and a face 32. Disposed within face 32 is a rectangular aperture 34, having rear edges on the rear surface 32*r* of the face 32 and front edges on the front surface 32*f* of the face 32, at approximately its center. The rear edges 35*b*, on the rear surface 32*r* of aperture 34, can be beveled along the rear surface (FIG. 4*a*). On the front surface 32*f* of face 32 are two segments 37, one segment 37 on each side of the vertical edges of aperture 34. Each segment 37 is triangular in shape, at the edge of the aperture, and tapers down to a smaller triangle at the extreme end of the face 32. The segments 37 help to minimize any air leakage between the aperture 34 and the user's lips.

The thickness 38 (FIGS. 5–5*c*) of the shield 26 can be any suitable dimension, thick enough for rigidity but thin enough for the user's lips to be in close proximity with a harmonica hole 18 (FIG. 1). The shield 26 can be fabricated from metal, plastic, PTFE, ceramic, wood, or any other suitable material.

Sides 28 and 30 (FIGS. 3–6*c*) are substantially perpendicular to face 32.

Figure 3:
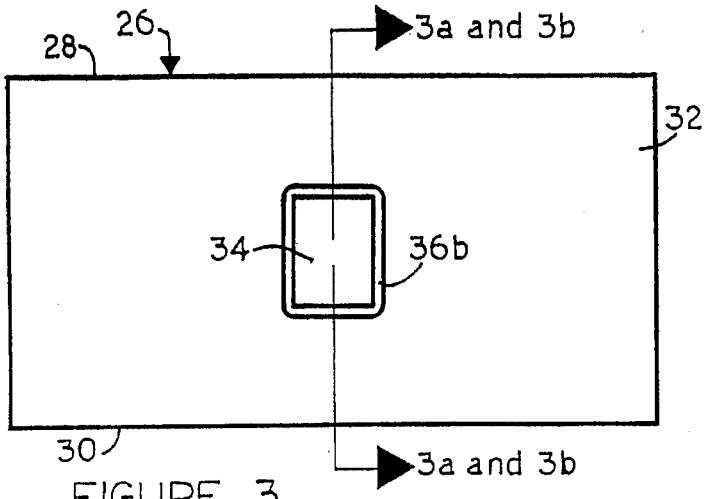
FIG. 3 illustrates a schematic view of the shield in accordance with the present invention.
Figure 3A:
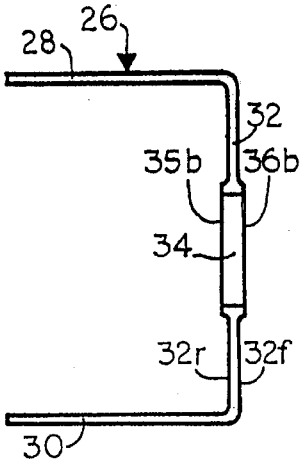
FIG. 3*a* illustrates a cross section view of an alternative embodiment of the shield shown in FIG. 3, along lines 3*a* and 3*b*—3*a* and 3*b* thereof.
Figure 3B:
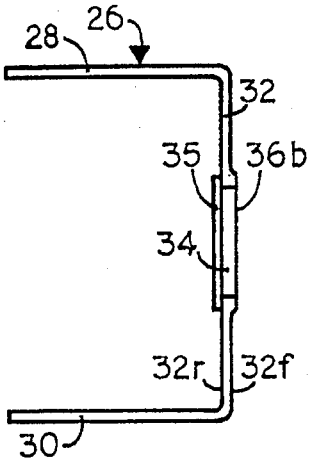
FIG. 3*b* illustrates a cross section view of the shield shown in FIG. 3, along lines 3*a* and 3*b*—3*a* and 3*b* thereof.
Figure 6:
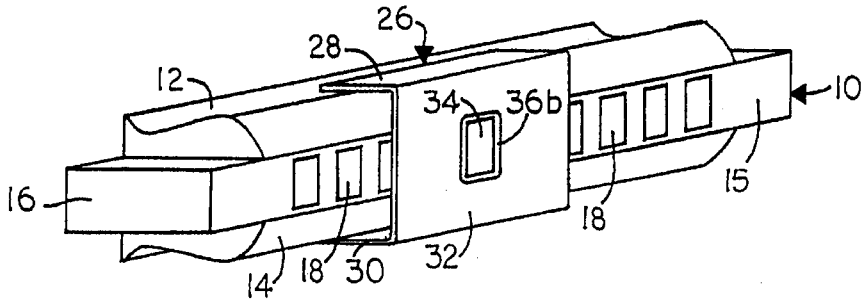
FIG. 6 is a perspective view of the shield shown in FIG. 3 in operative position relative to a 10-hole harmonica.

Referring to FIG. 6, there is shown a perspective view of the shield 26 shown in FIG. 3, in operative position on harmonica 10. In operation, the rear surface 32*r* of face 32 of the shield 26 is in proximity with the front surface 15 of the harmonica 10 (FIG. 1*a*). The rectangular aperture 34 of the shield 26 can be aligned with any desired hole 18 of the harmonica 10. By placing the lips on the front surface 32*f* of the face 32 of the shield 26, centered around the rectangular aperture 34 thereof, a single note or tone can be sounded by blowing into, or drawing air out of, the exposed hole 18 of the harmonica 10.

The rear surface of the shield 26 and the surface of the harmonica 10 are able to slide sideways with respect to one another in either direction. By placing the lips firmly on the shield 26, the shield 26 will remain stationary with respect to the lips, and the harmonica 10 can be slid sideways, by the hands, with respect to the shield 26, in either direction, to align any desired harmonica hole 18 with aperture 34 for sounding a note. In this manner a complete song can be played, one note at a time. Thus, the lips control the movement of the shield 26, while the two hands control the movement of the harmonica 10. Notice, the lips can slide or move the shield 26 sideways, if desired.

For the purpose of providing a seal to help eliminate rear air leakage between shield 26 and harmonica 10, the following features can be added to the present invention.

(a) Rectilinear strips 35 (FIGS. 3*b*, 4*b* and 5*a*) may be provided along the rear edges of the rear surface 32*r* of aperture 34.

(b) An O-ring 35*a* (FIGS. 5*b* and 5*c*), shown in phantom, may be provided about the aperture 34 on the rear surface 32*r* of the face 32 of the shield 26, in lieu of rectilinear strips 35.

The aforementioned air leakage seals 35, 35*a*, can be replaced by a suitable unitary structure, which can be fabricated easily by those skilled in the art.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention. This invention will be usable with 12-hole harmonicas, 14-hole harmonicas, double-hole harmonicas, chromatic harmonicas, etc.

I claim:

1. A template for shielding a harmonica during the playing thereof, said harmonica having a front surface with a plurality of holes therein, said template comprising a U-shaped frame, said frame having a face of a predetermined length and two sides attached to opposite edges of said face, said sides being substantially perpendicular to said face, said face having a planar front surface and a planar rear surface, said face having an aperture disposed therein, said aperture having front edges on said front surface of said face, said front edges being beveled, so that when said template is placed in operational relationship with said harmonica, said rear surface of said face is proximate said front surface of said harmonica, whereby, said aperture can be aligned with any desired one of said harmonica holes for facilitating the sounding of any one desired harmonica note.

2. The template in accordance with claim 1, wherein the length of said face thereof is sufficient to span at least three musical holes of said front surface of said harmonica.

3. The template in accordance with claim 1, wherein said aperture has rear edges on said rear surface of said face, and further comprising air sealing means affixed to said rear edges of said aperture.

4. The template in accordance with claim 1, wherein said aperture has rear edges on said rear surface of said face, and further wherein said rear edges of said aperture are beveled.

5. A template for shielding a harmonica during the playing thereof, said harmonica having a front surface with a plurality of holes therein, said template comprising a frame, said frame having a face and two sides attached to opposite edges of said face, said face having a planar rear surface and a front surface, said face having an aperture disposed therein, said front surface having two segments, said segments being on opposite sides, horizontally, of said aperture, said segments having a triangular shape at edge of said aperture, said segments tapering to a smaller triangular shape at extreme ends of the face so that when said template is placed in operational relationship with said harmonica, said rear surface of said face is proximate said front surface of said harmonica, whereby said aperture can be aligned with any desired one of said harmonica holes for facilitating the sounding of any one desired harmonica note.

6. The template in accordance with claim 5, wherein the length of said face thereof is sufficient to span at least three musical holes of said front surface of said harmonica.

7. The template in accordance with claim 5, wherein said aperture has rear edges on said rear surface of said face, and further comprising air sealing means affixed to said rear edges of said aperture.

8. The template in accordance with claim 5, wherein said aperture has rear edges on said rear surface of said face, and further wherein said rear edges of said aperture are beveled.

* * * * *